US008454263B2

(12) United States Patent
Lorenz

(10) Patent No.: US 8,454,263 B2
(45) Date of Patent: Jun. 4, 2013

(54) PRODUCTION-OPTIMIZED MANHOLE COVER

(75) Inventor: Thomas Lorenz, Wallenhorst (DE)

(73) Assignee: Thomas Lorenz Industrie Technik GmbH/Co. KG, Wallenhorst (DE)

( * ) Notice: Subject to any disclaimer, the term of this patent is extended or adjusted under 35 U.S.C. 154(b) by 0 days.

(21) Appl. No.: 13/542,772

(22) Filed: Jul. 6, 2012

(65) Prior Publication Data

US 2013/0011194 A1 Jan. 10, 2013

(30) Foreign Application Priority Data

Jul. 6, 2011 (DE) ..... 10 2011 051 611

(51) Int. Cl.
*E02D 29/14* (2006.01)

(52) U.S. Cl.
USPC ..... 404/25; 137/371

(58) Field of Classification Search
USPC ..... 404/25; 137/371; 52/19
See application file for complete search history.

(56) References Cited

U.S. PATENT DOCUMENTS

| | | | | | |
|---|---|---|---|---|---|
| 149,246 | A * | 3/1874 | Price et al. | ..... | 404/25 |
| 783,702 | A * | 2/1905 | Olds | ..... | 404/25 |
| 4,013,374 | A * | 3/1977 | Weiler et al. | ..... | 404/25 |
| 4,662,777 | A * | 5/1987 | Newton | ..... | 404/25 |
| 5,123,776 | A * | 6/1992 | Lang et al. | ..... | 404/25 |
| D428,658 | S * | 7/2000 | Glab et al. | ..... | D25/36 |
| D428,999 | S * | 8/2000 | Glab et al. | ..... | D25/36 |
| 6,393,771 | B1 * | 5/2002 | Stetson | ..... | 52/20 |
| 6,682,257 | B1 * | 1/2004 | Zappe | ..... | 404/25 |
| 6,887,012 | B1 * | 5/2005 | Zappe | ..... | 404/25 |
| 7,537,413 | B1 * | 5/2009 | Brugos | ..... | 404/25 |
| 7,914,227 | B2 * | 3/2011 | Jordan et al. | ..... | 404/25 |

* cited by examiner

*Primary Examiner* — Gary Hartmann
(74) *Attorney, Agent, or Firm* — Patricia M. Mathers

(57) ABSTRACT

A manhole cover is made of a fiberglass reinforced saucer-like shell that is filled with concrete. The interior surface of the shell is rough and the shell has a maximum thickness of 5 mm. An adhesive agent may be provided between the base and the filling, to obtain a reliable bond between base and filling. The concrete for the filling may be pure mineral concrete. One or more lifting handles are embedded in the filling. To this end, a recess for each handle is formed in the filling. The ends of the handle are embedded in the concrete and the lifting portion of the handle is curved upward and is held in the recess such that there is a space between the curved portion and the bottom of the recess, so that the handle may be easily grasped.

7 Claims, 2 Drawing Sheets

PRODUCTION-OPTIMIZED MANHOLE COVER

BACKGROUND INFORMATION

1. Field of the Invention

The invention relates to a manhole cover that is particularly simple and inexpensive to manufacture.

2. Discussion of the Prior Art

GB 2 145 444 A, the closest prior art, discloses a manhole cover that comprises only the two components of a base and a filling. The preferred material for the base of the manhole cover is the same material that is used for a manhole that is to be covered by the manhole cover, whereby, high-density polyethylene is named as an example. The manhole serves as access to the sewage system for inspection purposes. The disclosure does not mention how the manhole cover is arranged and what loads it can withstand.

An unconventional manhole cover is disclosed in DE 298 01 640 U1. This manhole cover has a metal outer shell on its bottom side, into which the actual base, which has a certain layer thickness, is then cast, whereby the filling is then cast into the base. The production of this manhole cover, which overall comprises a three-layer construction, is therefore technically complicated. The components or materials used are relatively expensive. Thus, for example, the outer shell is provided as a break-mold made of metal, and the base is constructed either of cast steel or of polymer concrete, the polymer concrete having thicker dimensions. The filling is also made of polymer concrete. The manhole cover is to be arranged in a track system and is constructed to withstand foreseeable high stresses caused by a high volume of traffic, high mechanical stresses, and aggressive climatic conditions.

U.S. Pat. No. 5,123,776 discloses a manhole cover that is constructed as a filled-in hollow body. A sheath surrounds the filling on all sides, so that the filling must be introduced into the sheath through a filler opening. The sheath is preferably made of polyethylene, and the filling preferably of concrete. Handles for lifting purposes are basically constructed as U-shaped brackets that open downward. They can be pulled up out of the manhole cover in a vertical direction, so that they can be gripped in order to raise the manhole cover. When in their lowered non-operational state, the lifting handles each rest in a recess that is provided in the surface of the manhole cover. The production of the manhole cover is complicated, because a hollow body must be filled, whereby providing the openings in the hollow body necessary for the vertical mobility of the lifting handles complicates the filling process. or, if the openings are not formed in the filling process, after the filling has hardened, several through-bores have to be made in the manhole cover to create channels through which the lifting handles can extend.

U.S. Pat. No. 4,974,992 discloses a cover that is not used as a manhole cover, but rather, is constructed as a metal plate and serves to cover trenches in street surfaces. The cover is used when digging work is suspended and traffic is allowed on the street surface. In order to withstand the traffic loads, the metal plates have appropriately sturdy dimensions and are consequently heavy. In order to simplify their handling, Omega-shaped handles that are rotatable on both ends are provided in the cover plate and can be swiveled from their downward-hanging resting position into an upright operational position in which they project upwards above the surface of the cover.

U.S. Pat. No. 4,801,483 discloses a cover that has a core with a cell structure, as well as an external, closed sheath layer made of a fiber-reinforced resin. The cover is to specifically sustain high dynamic loads, so that, e.g., the vehicles in road traffic can drive over the cover. The core can, e.g., be constructed of multiple balsa wood blocks, and the sheath layer of fiberglass-reinforced epoxy or polyester resin. The manufacture of the cover is complicated, because two separate parts of the sheath layer are produced. A first part of the sheath layer forms a recess into which the individual components of the core are inserted. The core is then covered with the second part of the sheath layer. One must ensure that both parts of the sheath layer are connected to each other at all contact points they share with one another and with the core structure, and that all air bubbles be avoided during this process, in order to create an essentially monolithic mass. Aids for lifting the cover are not provided; rather, the cover has armature bores that allow ground anchors to be inserted, so that the cover can be affixed to the substrate with the aid of these ground anchors.

In numerous instances, manhole covers are necessary in places other than streets. For example, inspection and maintenance manholes may be provided on private properties, e.g., in garage entrances, in order to provide access to the building's sewage system installations for cleaning and inspection purposes. Mechanical stress caused by heavy trucks is unlikely here, as is heavy traffic or high exposure to de-icing salt in the winter. Conventional manhole covers are therefore frequently overqualified for these applications and, due to their complicated production process or the costly materials used. are unnecessarily expensive.

The object of the invention is to improve a generic manhole cover in such a way that it can be produced as inexpensively as possible.

BRIEF SUMMARY OF THE INVENTION

The invention proposes creating a production-optimized manhole cover that does not necessarily have to withstand particularly high loads, such as occur, for example, in road traffic, but which can be used, for example, in driveways, on private property, and the like. The manhole cover according to the invention comprises a minimum number of components and is therefore economic to manufacture.

The manhole cover according to the invention comprises essentially just three different components:

The first component is a base that serves as a sort of a single-use or lost form. This base is constructed in the shape of a saucer, which allows the material of the filling to be filled into the form faster and in a less complicated manner than into a hollow form that is essentially closed on all sides.

The concrete filling is the second component and is poured into this base. The pouring process itself can be performed simply and quickly, and concrete is an inexpensive material, particularly since no special concrete is used, such as, for example, polymer concrete; rather, exclusively mineral concrete is used.

The third component is a lifting handle, which is recessed within the filling. The lifting handle facilitates handling the manhole cover.

The form that is initially required when pouring the filling later also forms the base of the completed manhole cover and serves as the protective layer, as well as a mechanical reinforcement of the manhole cover, though that only to a small degree. In view of the fact that the manhole cover according to the invention can be used particularly on properties with only light traffic, especially residential properties, a long-lasting connection of the base with the filling is desirable, if only for optical reasons. A gap between the base and the filling can gradually increase in size, due to ingress of water, which can then freeze. Apart from the fact that this could cause mechanical damage to the manhole cover, such a gap can collect dirt and plants can take root therein, so that the manhole cover presents an appearance of being neglected, which, in a residential setting is undesirable, or require an increased amount of care, For this reason, the prefabricated, saucer-shaped base is constructed with a rough surface on the interior side that faces the filling. This surface can either be left rough when the base is produced, or, if necessary, be especially roughened after the base has been made.

According to the invention, an adhesive agent is provided between the base and the filling in addition to the rough interior surface of the base, to ensure a reliable, gap-free bond between the base and the filling.

According to the invention, the base has a maximum layer thickness of 5 mm. On the one hand, this guarantees that the base has a sufficient intrinsic stability, in order to make it suitable as a casting mold, that is, as a lost form, for the concrete filling. On the other hand, this relatively low thickness of the base contributes to the most economical production possible of the manhole cover.

According to the invention, the base is made of fiberglass-reinforced plastic. In this way, not only is a casting mold created for the concrete filling, but, due to its material properties, the base also contributes to the strength and compressive loading of the manhole cover. In addition, the base is economic to produce, so that, even after the casting of the filling, it can easily also remain on the filling as a lost form. A coating, impregnation, or other treatment of the bottom side of the concrete filling is therefore not required to protect it against influences from the manhole that act on the manhole cover. Rather, the manhole cover may be used without further processing after the concrete filling is hardened in the saucer base.

A duroplastic plastic is used as the base. This material possesses adequate mechanical properties and is very affordable.

If necessary, an additional lifting handle may be provided, in order to provide two diametrically opposed points for handling the manhole cover. In this case, the manhole cover may be lifted or lowered as easily and smoothly as possible and without tilting. Both lifting handles may be produced as identical parts, so that only two different component types have to be prefabricated, namely. the base and the lifting handle, whereby for each manhole cover one base and one or two lifting handles are used. The filling itself does not have to be prefabricated as a component. but rather, is poured in a flowable state into the base, which thus acts as the form for the concrete filling.

The manhole cover is constructed with only a very small number of components. This means that only relatively few components need be prefabricated, which simplifies the production of the manhole cover. Storage and/or transport costs for prefabricated components are also reduced. The fact that only a very small number of components have to be connected to one another in order to form the manhole cover provides an additional simplification in the production process of the manhole cover, so that, overall, the production costs for the manhole cover are very economical.

Because it is so economical to produce, the manhole cover is particularly suitable for applications for which the acquisition costs of the manhole cover, and not its maximum load capacity, are of utmost importance. For example, the manhole cover according to the invention may be constructed to bear loads between 15 t and 20 t, in contrast to the manhole covers that, for example, are used in road traffic and are able to withstand up to 40 t. In particular, it is technically possible to construct the manhole cover to withstand a load of only 5 t, so that relatively inexpensive materials may be used or the thickness of the base or the filling may be correspondingly thin. Within the framework of official German load classes, the technically possible load capacity of 5 t, for example, means that a permit or allowance for up to 1.5 t for use in public areas, for example, on sidewalks or the like, and for driving automobiles on private, non-public property and garage driveways, is generally sufficient. in order to be able to guarantee a load capacity of 5 t, it may be advantageous to construct the manhole cover, with regard to materials and thickness, such that the manhole cover is destroyed only under a load of 6 t or more, whereby the force that causes the destruction is called the bursting force.

The inexpensive production of the manhole cover may advantageously be enhanced by providing not just one, but two, lifting handles that are arranged diametrically opposed to each other. In this way, the cover may be lifted or lowered without tilting, which, in contrast to the use of only a single lifting handle, reduces the loads applied to the manhole cover because, for example, the use of two lifting handles reduces canted loading on the cover, caused by a diagonal orientation of the cover. Also, the use of two handles reduces the loading on the individual lifting handles and the locations where the lifting handles are anchored in the filling. Despite the greater use of materials, the arrangement of two lifting handles instead of one lifting handle surprisingly reduces the cost of production of the manhole cover, because the manhole cover may now be constructed to withstand these lesser loads.

Advantageously, the lifting handle may be formed from a wire, preferably a rust-free, stainless steel wire, the two ends of which are anchored in the filling, whereby a recess is provided in the filling through which the wire extends, so that the mid-section of the wire runs inside the recess and can be gripped from underneath with appropriate lifting tools. This recess ensures a countersunk arrangement of the lifting handles, so that they do not protrude above the surface of the manhole cover, and this reduces the loads applied to the lifting handles because of someone walking or driving over the manhole cover, etc.

The lifting handle may advantageously be immovably anchored in the filling, instead of being movable between an idle and an operational position. This simplifies the production of the manhole cover, and also makes it more economical. Since one can assume that, in most applications, the manhole cover will not have to be removed from the manhole on a daily or weekly basis, but rather, at most, at intervals of several months or even several years, a manhole cover construction that entails additional costs and that possibly facilitates the handling of the lifting handle does not make economic sense in most such cases. In view of the long intervals between instances when the lifting handle is used, it is also questionable whether, if need be, such a lifting handle can actually be moved easily or is possibly difficult to move because of dirt, corrosion, or similar effects, in which case the desired easier handling of the lifting handle would not be achieved.

Advantageously, the handle may be constructed as a curved rather than straight element, having a mid-section that curves upward. This configuration achieves the largest possible space under the mid-section of the lifting handle with the smallest possible depth of the recess in the filling, so that the handle can be gripped without a problem—even though it is immovably anchored in the filling. A weakness in the filling, which can be caused by the recess and the correspondingly reduced material thickness, can be kept to a minimum by a recess construction that is as flat as possible. This enables construction of an adequately strong manhole cover with the smallest amount of material.

For economic reasons, it may be advantageous to construct the fiberglass-reinforced plastic without complicated longitudinal rovings that possess especially good mechanical properties, but rather, advantageously, to use non-directional fiber mats as reinforcing fibers, which are less expensive to procure than the aforementioned rovings. The strength properties of the manhole cover that are attainable by means of the concrete filling are adequate in any case, so that the improvement in strength and load capacity of the manhole cover that is achieved by means of the base ensures sufficient load properties for the manhole cover, even when such non-directional fiber mats are used in the base.

The concrete that is used as the filling does not require heavy-duty or polymer concrete or the like, that is, concrete with special aggregates, to achieve the desired load capacity; instead, for economic reasons, the concrete may be formed as pure mineral concrete. The adequate strength and load capacity properties of the manhole cover may also be easily achieved using such a simply constructed concrete material if, for example, the aggregates used are combined in the appropriate manner, as is known from practical applications, by using sand, for example, with a particular granularity, that is, of a certain so-called sieve curve, so that by adjusting the individual, variously sized aggregates in the concrete, adequate strength values for the filling, and thus for the entire manhole cover, are achieved.

BRIEF DESCRIPTION OF THE DRAWINGS

An embodiment of the invention is explained in detail using the purely schematic drawings.

DETAILED DESCRIPTION OF THE INVENTION

Figure 1:
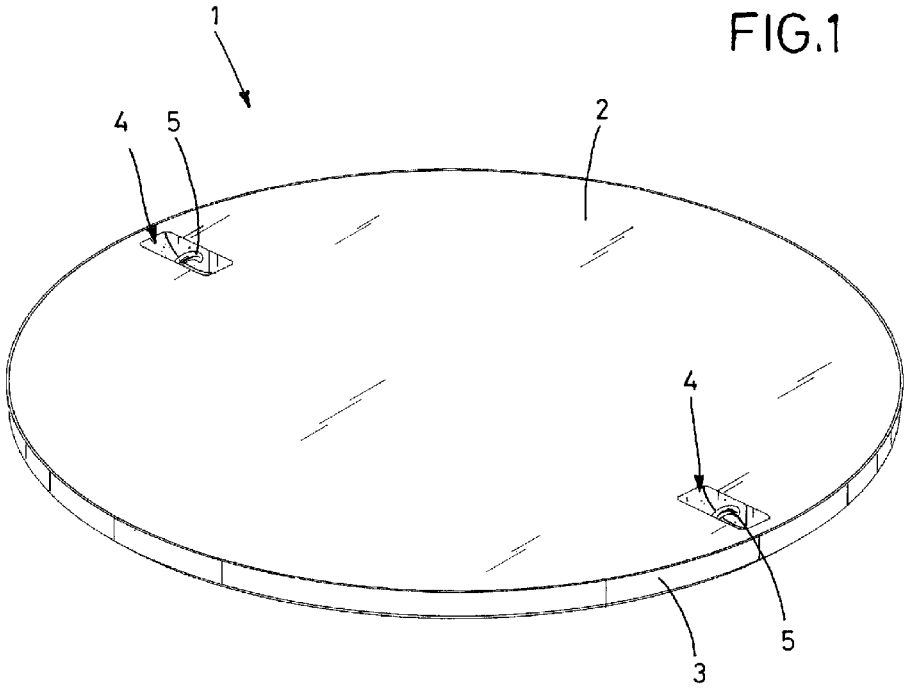
FIG. 1 is a perspective view of the manhole cover according to the invention.
Figure 2:
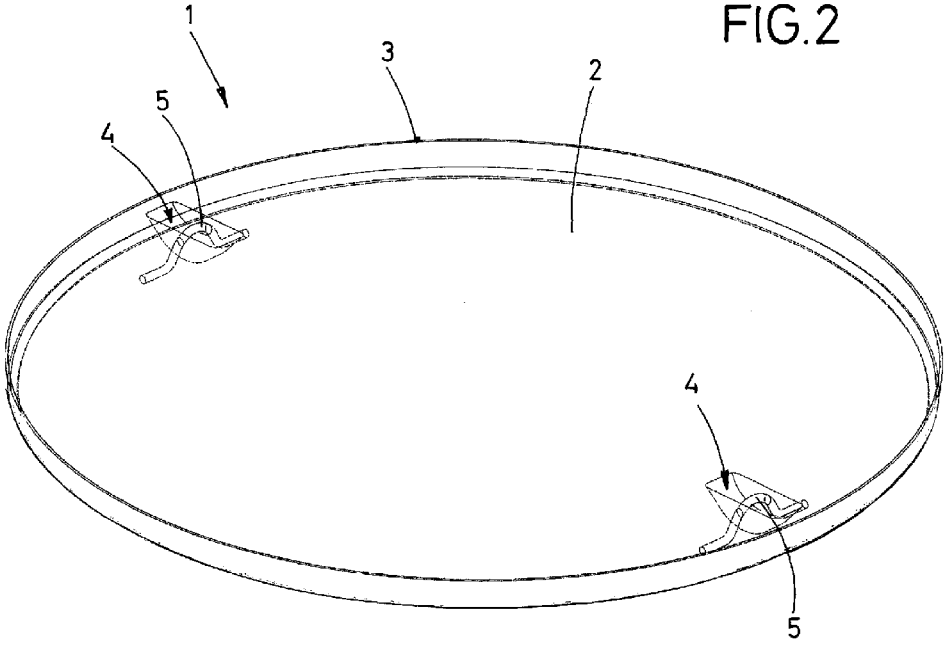
FIG. 2 is perspective view of the manhole cover, showing the recesses and lifting handles in the filling.
Figure 3:
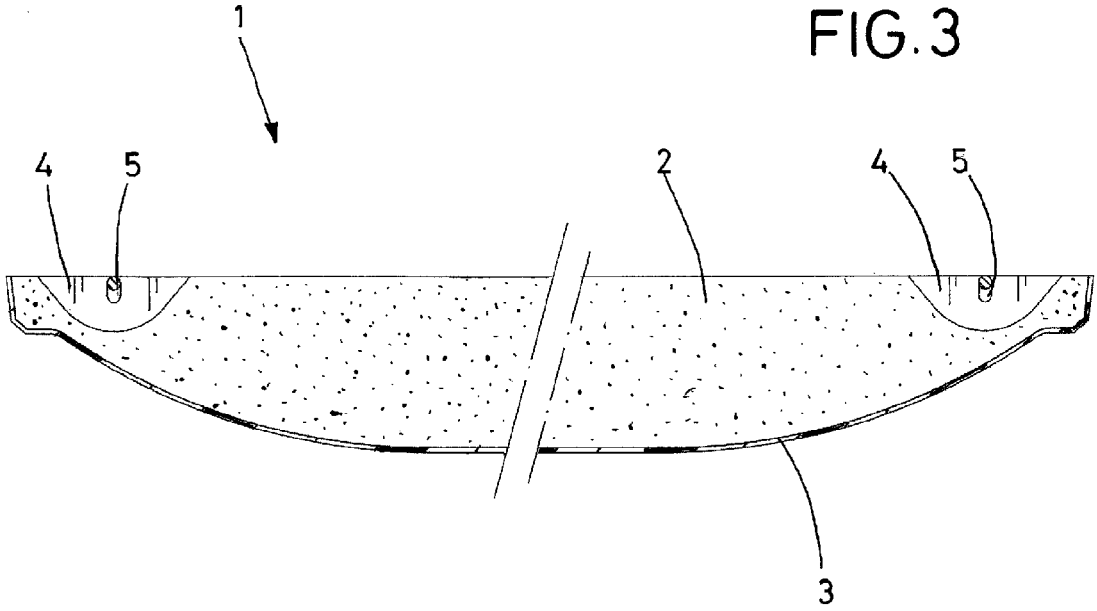
FIG. 3 is a cross-sectional view of the manhole cover.

FIGS. 1-3 illustrate a manhole cover 1, which is essentially made of concrete. A plastic saucer-shaped shell 3 serves as a form for a concrete casting. A concrete mixture or filling 2 is poured into the shell 3 to form a base 3. The base 3 thus has the form of a filled saucer, whereby the shell 3 remains as part of the base 3 and serves as an outer bottom surface and as a side wall of the manhole cover 1.

In the embodiment shown, two recesses 4 are formed in the filling 2, the recesses 4 positioned diametrically opposite each other. A lifting handle 5 is provided in each recess 4. The lifting handle is preferably a length of wire, the free ends of which are anchored in the filling 2.

As shown in FIG. 2, the lifting handle 5 has a middle portion that is curved, with two straight ends embedded in the filling 2. The curved portion extends upward in the recess, so as to provide a space between the middle portion and the bottom of the recess 4. This construction has the advantages that the thickness of the filling 2 can be relatively thin, yet still provide an excellent hold for the handle ends, because the ends are embedded in the thicker part of the filling 2. The lifting portion of the handles 5 can readily be gripped because of the space between the lifting portion and the bottom of the recess 4.

Only three different components are used for producing the manhole cover 1, namely, the base 3 into which the filling 2 is then poured, whereby the lifting handle 5 is embedded into the filling 2. Depending on whether two or more handles 5 are used on the manhole cover 1, duplicates of the handle 5 may be required, but from a technical production standpoint, the manhole cover 1 is constructed of just three different components. The concrete for the filling 2 is a relatively simple and economical concrete material. Pure mineral concrete, that is, concrete without polymer additives or the like, and without fiber reinforcements or the like, is sufficient for the intended purposes of the manhole cover 1 according to the invention. As a result, the production of the manhole cover 1 to the required strength specifications is particularly cost-effective.

It is understood that the embodiments described herein are merely illustrative of the present invention. Variations in the construction of the manhole cover may be contemplated by one skilled in the art without limiting the intended scope of the invention herein disclosed and as defined by the following claims.

The invention claimed is:

1. A manhole cover consisting of:

a base constructed of a fiberglass-reinforced, duroplastic material, the base having a roughened interior surface and having a maximum material thickness of 5 mm;

a concrete filling that is filled into the base, the concrete filling being a pure mineral concrete and having a lower surface and an upper surface;

an adhesive agent between the interior surface of the base and the lower surface of the filling; and a lifting means that includes a recess formed in the concrete filling and a lifting handle having two ends that are embedded in the concrete filling and a lifting portion that extends across the recess.

2. The manhole cover of claim 1, wherein the lifting means includes two lifting means, spaced diametrically opposed relative to a mid-point of the manhole cover.

3. The manhole cover of claim 1, wherein the recess has a bottom surface and the lifting handle is constructed of a wire, the lifting portion being curved upward relative to the bottom surface of the recess.

4. The manhole cover of claim 1, wherein the lifting handle is immovably anchored in the concrete filling.

5. The manhole cover of claim 1, wherein the fiberglass-reinforced, duroplastic material is reinforced with non-directional fiber mats.

6. The manhole cover of claim 1, wherein the concrete filling and base are dimensioned to withstand allowable weight loads up to 5 tons.

7. The manhole cover of claim 6, wherein the concrete filling and base are loadable to a bursting force of 6 tons.

* * * * *